US008276625B2

(12) United States Patent
Dulst

(10) Patent No.: US 8,276,625 B2
(45) Date of Patent: Oct. 2, 2012

(54) PRESERVATION DEVICE AND CONTAINER STOPPER FOR USE THEREWITH

(76) Inventor: Marc Dulst, Blanden (BE)

( * ) Notice: Subject to any disclaimer, the term of this patent is extended or adjusted under 35 U.S.C. 154(b) by 396 days.

(21) Appl. No.: 12/602,850

(22) PCT Filed: Jun. 4, 2008

(86) PCT No.: PCT/EP2008/056934

§ 371 (c)(1),
(2), (4) Date: Dec. 3, 2009

(87) PCT Pub. No.: WO2008/148816

PCT Pub. Date: Dec. 11, 2008

(65) Prior Publication Data

US 2010/0183788 A1 Jul. 22, 2010

(30) Foreign Application Priority Data

Jun. 4, 2007 (EP) ..... 07010946

(51) Int. Cl.
*B65B 31/00* (2006.01)

(52) U.S. Cl. ..... 141/64; 141/19; 141/59; 141/301; 141/353; 215/311

(58) Field of Classification Search ..... 141/5, 17, 141/19, 37, 59, 64, 193, 285, 301, 351, 353, 141/363, 366; 215/311
See application file for complete search history.

(56) References Cited

U.S. PATENT DOCUMENTS

| | | | | |
|---|---|---|---|---|
| 4,473,174 | A | 9/1984 | Heuser | |
| 4,702,396 | A * | 10/1987 | Gwiazda | 222/152 |
| 4,867,209 | A | 9/1989 | Santoiemmo | |
| 5,458,165 | A | 10/1995 | Liebmann, Jr. | |
| 6,595,109 | B2 | 7/2003 | Liebmann, Jr. | |
| 2002/0117040 | A1 | 8/2002 | Iwao | |

FOREIGN PATENT DOCUMENTS

| | | | |
|---|---|---|---|
| EP | 1 548 098 | A1 | 6/2005 |
| WO | WO 01/12507 | A1 | 2/2001 |
| WO | WO 2004/066749 | A2 | 8/2004 |

* cited by examiner

*Primary Examiner* — Gregory Huson
*Assistant Examiner* — Jason K Niesz
(74) *Attorney, Agent, or Firm* — Bacon & Thomas, PLLC

(57) ABSTRACT

A device and method for preservation of an oxidizable substance, e.g. a liquid such as a beverage of which wine is an example, is described. In a first aspect, a device is described for controlling the delivery of a predetermined amount of inert gas into a container with a single opening such as a wine bottle at a pre-determined pressure, suitable for an efficient delivery of the inert gas, with a simultaneous displacement of the air present in the top space of the container or bottle, in a simple actuation. In a second aspect, an improved container or bottle stopper is described with simple features that allow easy and cheap manufacture significantly reducing the cost of the stopper. In a third aspect to an efficient and cost-effective method is described for the preservation of a degradable substances especially liquids such as beverages of which wine is an example.

17 Claims, 3 Drawing Sheets

PRESERVATION DEVICE AND CONTAINER STOPPER FOR USE THEREWITH

FIELD OF THE INVENTION

The invention relates to the preservation of degradable substances (e.g. degradable by oxidation) such as liquids or powders, especially edible substances, beverages (e.g. wine), or foods (e.g. coffee) as well as oils, tobacco, pharmaceuticals, colorants or paints in an opened container, e.g. a bottle, exposed to the oxygen of the air. In a first aspect, the invention relates to a device for injecting or controlling the injection of an amount of an inert gas suitable for significantly lowering the content of oxygen in the top space of the container or bottle, therefore preserving the substance such as a beverage, e.g. wine. In a second aspect the invention relates to a container or bottle stopper for use with the device of the first aspect or independently. In another aspect the invention relates to a method for preserving a degradable substance, such as a liquid or powder, especially beverages such as wine in an opened bottle or a food powder, such as coffee in an open container.

BACKGROUND OF THE INVENTION

It is well known that once a wine bottle is opened but its content is not consumed rapidly, the oxygen present in the air introduced in the bottle can deteriorate the taste, the color and/or the flavor of the wine, which can result in the remaining wine being discarded. Beside the direct loss to a private consumer, this spoiling of the wine is a reason why most of establishments serving wine serve the more expensive wine only by the bottle and not by the glass, since the wine spoiling would represent a significant loss.

Wine preservation systems addressing the problem of wine spoiling are known. One way to address this problem is to reduce the pressure of the air in the bottle, which can be done, for example by fitting a rubber stopper having a one-way valve and removing the air in the bottle with a vacuum pump removably fixed on the stopper. This type of method usually allows some reduction in taste deterioration of the wine for a few days but has the drawback of not only removing the air from the bottle but also removing volatile flavoring molecules of the wine which can result in an alterted taste, color and/or flavor of the wine. Moreover, this type of method usually uses a hand-actuated vacuum pump, which requires several hand actuations in order to get a sufficient vacuum for an effective preservation. Hence, the degree of preservation is dependent upon user diligence.

Another way to address the spoiling of the wine is to replace the air in the bottle by an inert gas, such as e.g. argon, nitrogen, carbon dioxide or inert gases mixtures. It is known to use an aerosol-style can to deliver an inert gas or a mixture of inert gases into the wine bottle through a straw attached to the can. This system presents several drawbacks as the amount of gas introduced depends on the duration of the spray and the way the straw is inserted in the bottle, making it difficult for the user to use the system consistently and without wasting inert gas, e.g. by over-spraying. There is no limit on the time that pressure can be applied to the spray button, even leading to the delivery of the full content of the can. This can raise another problem, which requires this type of can to be stored in places that are not accessible to children.

A wine dispensing cabinet is known in which an inert gas is introduced in the bottle by an inlet channel pressuring the content of the bottle and allowing to dispense the wine through the outlet by opening a valve. The major drawbacks of this wine dispensing cabinet are its high cost and the fact that it is not ideally adapted to private consumers, e.g. the space requirements of such a system being particularly inconvenient for private consumers or an establishment serving a large number of different wines.

A wine preserving assembly is described in U.S. Pat. No. 6,595,109-B2 that uses a bottle stopper onto which a inert gas supply can be fixed in order to simultaneously introduce the inert gas into the wine bottle through an inlet and evacuating air contained in the head-space of the bottle. The main drawback of this system is that the stopper is a quite complex assembly of valves and a piston, which makes it expensive for the general public, particularly when several wine bottles are to be preserved, since every bottle will require a stopper.

A wine preservation system is also described in European patent application No EP1548098. This approach also uses a bottle stopper on which an inert gas supply can be fixed to introduce inert gas into a bottle. In this system the inert gas is introduced at a pressure of about two atmospheres, the stopper including an outlet valve which allows the gas to exit the bottle only when a pressure slightly under two atmospheres is obtained. Even though the stopper of this system does not include a piston, the complete device is costly since it includes different valves, particularly a pressure specific outlet valve and also due to the system of fixation to the bottle that must be able to sustain a pressure of about two atmospheres. This makes it costly, particularly when several wine bottles are to be preserved, since every bottle will require a stopper.

Therefore, there is still a need for an effective, low-cost and easy to use method for preservation of degradable substances, e.g. for wine preservation.

SUMMARY OF THE INVENTION

The present invention provides an improved devices and methods for the preservation of degradable substances, for example degradable by oxidation. Examples can be edible substances such as beverages (e.g. wine), or food powders (such as coffee) or oil, tobacco, pharmaceuticals or paints. An advantage of the present invention is that it may overcome at least partially a drawback of known systems.

In a first aspect, the present invention provides a device for controlling the delivery of a pre-determined amount of inert gas into a container with a single opening such as a wine bottle, at a pre-determined pressure, suitable for an efficient delivery of the inert gas, with a simultaneous displacement of the air present, for example in the top space of, the container or bottle, in a simple actuation.

In a second aspect, the present invention provides an improved container or bottle stopper with simple features that allow easy and cheap manufacture significantly reducing the cost of the stopper. This has the advantage that the preservation process itself is more economical, which is particularly beneficial when several containers, e.g. wine bottles are to be preserved.

In another aspect the present invention relates to an efficient and cost-effective method for the preservation of a degradable substances especially liquids such as beverages of which wine is an example.

DETAILED DESCRIPTION OF THE INVENTION

Figures 1, 2:
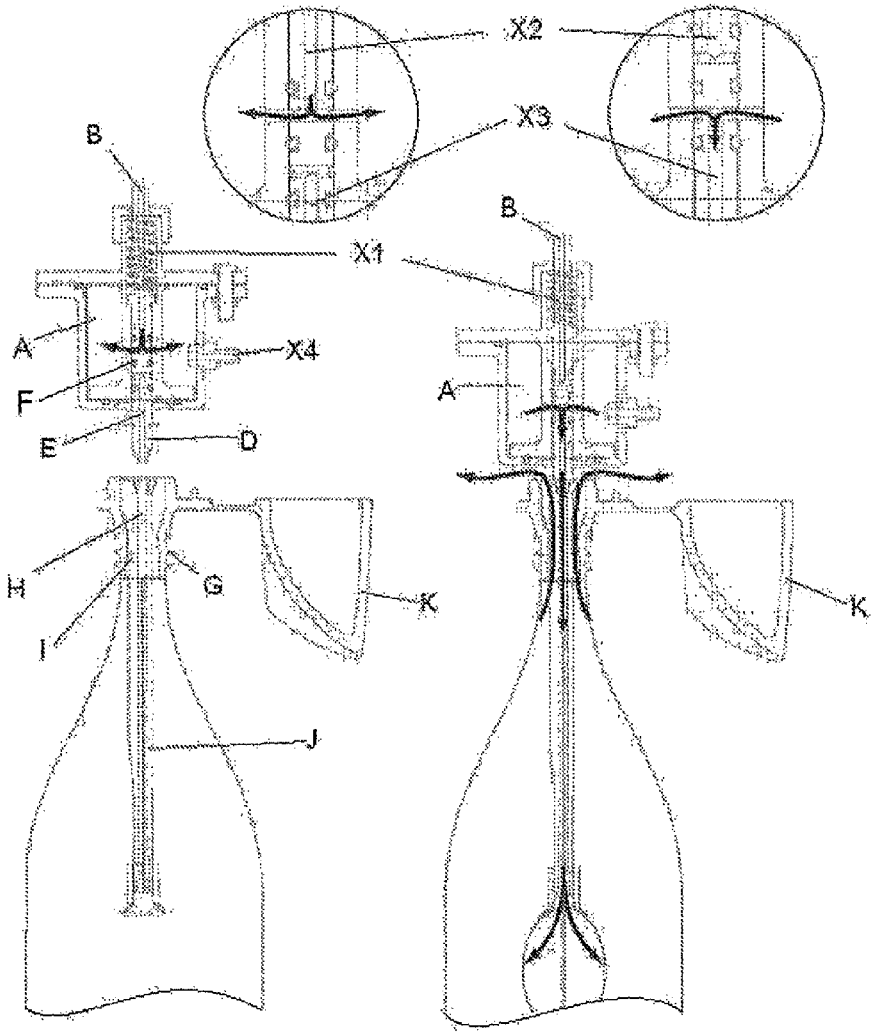
FIG. 1 is a schematic representation of a specific embodiment of the inert gas injecting device and stopper before actuation.
FIG. 2 is a schematic representation of a specific embodiment of the inert gas injecting device and stopper during actuation.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps.

As used herein, unless otherwise stated, the term "inert gas" is referring to any gas that is not reactive under normal conditions and/or the conditions in which it is used for the preservation of degradable substances. It includes elemental gases (e.g. noble gases, etc. . . . ) as well as molecular gases (e.g. nitrogen, carbon dioxide, etc. . . . ).

It has been found that the preservation of a degradable substance, e.g. an oxidizable substance especially solids or liquids such as a beverage of which wine is one example, in an opened container such as a wine bottle can be significantly improved by controlling the way the inert gas is introduced into the container or bottle, which further allows to reduce the amount of inert gas such as argon required for an efficient preservation of the substance, e.g. wine.

In its first aspect, the present invention provides a device for use in the preservation of a degradable substance in a container with an opening, the device comprising:

- a gas chamber (A),
- a first connecting means (B) for connecting a pressurized inert gas supply to the gas chamber,
- a charging head (D) for delivering gas into the container,
- a second connecting means (E) for connecting the gas chamber (A) to the charging head (D),
- actuation means (F) for delivering the gas from the gas chamber to the container through the charging head (D),
- wherein the pressure in said gas chamber (A) is regulated to a predetermined pressure when the pressurized gas supply is connected to the gas chamber (A), and wherein the second connecting means (E) is disabled when the actuation means (F) is at rest and that the first connecting means (B) is disabled upon actuation of the actuation means (F) allowing the device to deliver a pre-determined amount of the inert gas through the charging head (D).

The substance to be preserved can be a beverage such as wine and container can be a beverage container with a single opening such as a wine bottle. The device of the first aspect of the present invention provides an improved solution to the preservation of substances such as wine as by a simple actuation from the user, the device delivers a pre-determined amount of inert gas, into the container or bottle, providing an effective preservation of the substance such as wine without an excess of inert gas being used. When at rest, the gas chamber (A) of the device is connectable, through the first connecting means (B), to a pressurized inert gas supply, e.g. in the form of a canister or a cartridge, and the pressure in the gas chamber (A) is regulated to a pre-determined value. Upon actuation of the actuation means (F) by the user, the first connecting means (B) is disabled and the second connecting means (E) is activated, allowing the inert gas content of the gas chamber (A) to flow through the charging head, thereby delivering a pre-determined amount of inert gas into the container, e.g. wine bottle.

In a specific embodiment, the device according to the first aspect of the invention also provides the improvement that a single actuation cannot lead to the delivery of a large content, e.g. the full content of the gas supply and that actuation of the device does not lead to a substantial increase of the pressure in the container or bottle.

The form of first connecting means (B) for attaching an inert gas supply such as a canister or cartridge to the gas chamber is not a limiting feature of the invention and any connecting means known in the art can suitably be used for the present invention. For example the connecting means (B) can comprise a screw fitting having a mating thread to which the threads of an inert gas canister or cartridge can fit in an air-tight way. Other attachments can be used, e.g. a bayonet fitting.

In a specific embodiment the device of the first aspect of the invention further comprises regulating means (C) for regulating the pressure of a gas in the gas chamber (A) to a predetermined pressure when pressurized gas supply is connected to the gas chamber (A). The type of regulating means (C) used for regulating the pressure in the gas chamber (A) is not a limiting feature of the present invention, and can be selected from among regulating means known in the art. It can be, for example, connected to the gas chamber (A) itself or be comprised in the first connecting means (B). Preferably, the regulating means is of reduced size that will allow the device to be of a reasonable size, easily used by the user, for example the regulating means (C) can be in the form of a pressure reducing valve. In another embodiment the first connecting means (B) comprises the regulating means (C) for regulating the pressure in the gas chamber.

In another embodiment the regulating means is in the pressurized inert gas supply and therefore is not necessarily comprised in the device it-self in order to have the pressure in said gas chamber (A) regulated to a predetermined pressure when the pressurized gas supply is connected to the gas chamber (A). In such an embodiment the inert gas supply can for example be in the form of a spray can.

As used herein the term "charging head" refers to the part of the device having an appropriate shape for delivering the inert gas into a container such as a bottle. For example, the charging head can have a substantially conical shape which allows, when fitted on a stopper, (e.g. according to the second aspect of this invention), the delivery of the inert gas into the container, e.g. bottle through the inlet-channel and nozzle of such a stopper.

Inert gases that are suitable for use with the present invention are for example, but not limited to, argon, nitrogen, carbon dioxide, and mixtures thereof. In a specific embodiment the inert gas or inert gas mixture preferably comprises at least one gas that is heavier than air. In a specific embodiment where wine is the substance to be protected the inert gas is preferably not carbon dioxide, and most preferably the inert gas is argon.

The value of the pre-determined pressure to be obtained in the gas chamber (A) is not a limiting feature of the invention as long as it allows the delivery of an appropriate amount of inert gas for an efficient preservation of the substance, e.g. wine in the container, e.g. bottle, in a safe and convenient way. In particular the pre-determined pressure is preferably low enough to insure the safe delivery of the gas in a substantially non-turbulent way and avoid extensive mixing with the air in the container, e.g. bottle. Preferably, the pressure is selected to that the entrant gas gently pushes the air from the head space of the container to the outside. The pre-determined pressure is correlated to the volume of the gas chamber (A) since these two factors will determine the pre-determined amount of inert gas to be delivered. For example, in order to have a device of a relatively easy-to-use size, the pre-determined pressure can be less than 10 bar, preferably between 3 and 7 bar, e.g. between 4 and 6 bar.

The pre-determined amount of the inert gas, is directly correlated to the volume of the gas chamber (A) and the pre-determined pressure in the gas-chamber (A). It is an important feature of the invention, which should be adapted to the type of container, e.g. bottle in which the substance, e.g. wine is to be preserved. In order to determine a suitable optimized amount of gas in a wine bottle that maintains taste, extensive experiments have been carried out on white and red wines, young and old wines, as well as different kind of wines (bourgogne, bordeaux, . . . ), different bottle shapes and different levels of wine remaining in the bottles. In a particular embodiment, a device according to the first aspect of the present invention provides the inert gas such as argon in a predetermined amount between 50 and 500 ml, e.g. between 100 and 200 ml, preferably about 150 ml. This is optimized to preserve the wine content of a half-full 750 ml wine bottle. In a specific embodiment, e.g. where a three day preservation of the wine is desired, the amount of inert gas to be introduced in the bottle can be selected to reduce the amount of oxygen present in the head space of the bottle to less than 12% by volume, preferably to less than 10% by volume, most preferably less than 8% by volume. This may be suitable for use with other beverages subject to oxidation damage as well. In another embodiment where a longer preservation time is desired, for instance one or two weeks, the amount of inert gas introduced reduces the oxygen present in the head space of the bottle to less than 5% by volume, preferably to less than 3% by volume.

In another particular embodiment, a device according to the first aspect of the present invention provides the inert gas in a predetermined amount between 400 and 600 ml, or 500 ml or more. This embodiment is particularly useful for the preservation of wine in large bottles of several liters, such as bottles of 1.5 to 9 liters, e.g. bottles or casks of 5 or 7 liters.

In yet another embodiment of the first aspect of the invention, the device can be used with a pressurized carbon dioxide supply and a stopper able to sustain high pressure and can be used for the preservation of champagne or sparkling wines.

In a second aspect, the present invention provides a container or bottle stopper for a container with an opening that is particularly suitable for the use with the device of the first aspect, comprising:

- a skirt (G) for sealing the outside part of the stopper to the inside of the opening,
- an inlet channel (H) allowing a gas delivered by a charging head to enter the container,
- one or more outlet channels (I) allowing air in the container to exit,
- a nozzle (J) extending the inlet channel of the stopper inside the container,
- closing means (K) for preventing the air outside the container to access the inlet channel (H) and the one or more outlet channels (I).

It is important that the one or more outlet channels (I) have a cross-section sufficient for allowing the air from the head part of the container, e.g. bottle to exit the container, e.g. bottle efficiently when the inert gas is delivered through the stopper. Preferably the ratio of the cross section of the one or more outlet channels (I) to the cross section of the inlet channel (H) is at least 1.5, for example at least 2.

The size or shape of the nozzle is not a limiting feature of the present invention, but it is important that the inert gas is introduced into the container, e.g. bottle in a substantially non-turbulent way, preferably at the center of the cross section of the opening in the container. For example, the nozzle can have the form of a tube having a length between 1 and 15 cm, e.g. between 10 and 15 cm for delivering the gas close to the level of a half-full wine bottle of 750 ml, or the nozzle can be in the form of a tube having a length of about 3-4 cm as to induce a substantially non-turbulent flow of inert gas into the bottle while its length is not longer than the usual label found on the neck of the bottle. The nozzle can also be removable from the stopper, e.g. to allow cleaning or to allow use with a different stopper, or to allow the use of nozzles of different size with the same stopper to adapt to the level of wine inside the bottle. In a particular embodiment the bottle end of the nozzle (J) is connected to a diffuser, e.g. to provide a laminar flow of gas into the container.

The material from which the stopper is made is not a limiting feature of the invention, the materials known in the art for making an air-tight stopper can be suitably used for the invention. For example the stopper can be made of natural or a synthetic rubber or elastomer or any polymer having oxygen barrier properties.

The closing means (K) can be any type of air-tight closing means known in the art, for example the closing means can be in the form of a press-fit lid, preferably attached to rest of the stopper.

The stopper provided by the second aspect of the present invention has simple features that can be easily obtained in low-cost manufacturing process for example, but not limited to, by molding in a thermoplastic material. The low cost of the stopper according to the second aspect of the invention can improve the accessibility to an efficient wine preservation process even for low budget wine lovers. Since a single wine preservation device according to the first aspect of the invention can be used to protect the wine of several different bottles, with only the need of supplemental stopper, the low cost of the stopper is particularly beneficial for the low-cost aspect of the general process of wine preservation of several bottles.

In a specific embodiment the stopper of this aspect of the invention can be used directly with a pressurized inert gas supply, as for examples an inert gas spray can or a single dose pressurised inert gas supply.

Another aspect of the invention is to provide an effective method for preserving a substance such as wine in a container, e.g. a wine bottle comprising the steps of:

(i) providing a predetermined amount of inert gas at a predetermined pressure from a pressurized inert gas supply, e.g. by filling a gas chamber with an inert gas from a pressurized inert gas supply up to a predetermined pressure, (ii) interrupting the supply of gas from the pressurized inert gas supply, e.g. by closing a connection between the gas chamber and the pressurized inert gas supply, (iii) opening a gas channel connection between the gas chamber and the bottle, e.g. by opening a connection between the gas chamber and the bottle, (iv) delivering the predetermined amount of inert gas to the container, e.g. by delivering inert gas from the gas chamber to the container, (v) allowing air in the container to exit the container, (vi) closing the container, wherein steps (ii), (iii), (iv) and (v) are performed simultaneously by a single actuation.

In a general way the device of the first aspect of the invention is used to preserve the wine inside a bottle after the bottle has been opened even after a significant part of the wine have been consumed. First the inert gas is to be introduced in the bottle. According to some embodiments of the present invention this is done by fitting a stopper, preferably a stopper according to the second aspect of the invention, on the neck of the bottle, fitting the device of the first aspect of the invention on top of the stopper, actuating the actuation means to deliver a pre-determined amount of inert gas into the bottle, remove the device and close the stopper to prevent the air from outside the bottle to get in.

To facilitate understanding the present invention will be further described through further embodiments.

Figure 3:
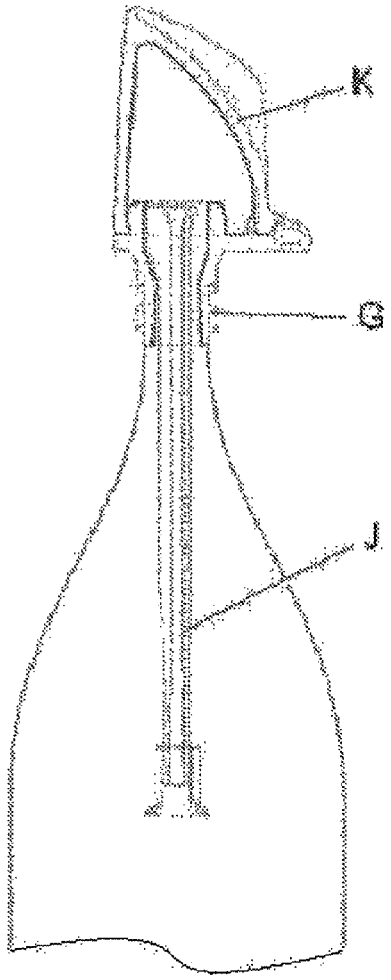
FIG. 3 is a schematic representation of a specific embodiment of the stopper on a bottle, after closure of the closing means (K).

A first embodiment of the first and second aspects of the present invention are shown schematically in FIG. 1, FIG. 2 and FIG. 3. A pressurized inert gas supply, e.g. argon cartridge or canister (not shown) is connected to a gas chamber (A) (or gas chambers) and the pressure is regulated to a value, e.g. of 5 bar with regulating means (not shown) connected to the gas chamber (A) by a further connecting means (X4). The actuation means (F) is, in this example, in the form of a spring mounted piston (X1) having two T-shaped internal channels (X2 and X3), the first internal channel (X2) being connected to the inert gas, e.g. argon, canister or cartridge through connecting means (B) and the second channel (X3) being connected to a charging head (D). At rest, as represented in FIG. 1, the piston is forced by the spring into a lower position where the openings of the gas chamber are in contact with the T-shaped internal channel (X2) of the piston that is connected to the argon canister or cartridge, therefore filling the gas chamber (A) with argon. Upon actuation, as represented in FIG. 2, by pressing the charging head (D) onto the upper part of the stopper, the piston is pushed into a higher position where the T-shaped channel (X2) connected to the canister or cartridge is moved away from the openings of the gas chamber, disabling the connection between the canister or cartridge and the gas chamber. At the same time, the T-shaped channel (X3) connected to the charging head is moved in front of the openings of the gas chamber, allowing the argon from the gas chamber to flow through the charging head, e.g. into a wine bottle. The gas passes successively through the charging head (D), the inlet channel (H) and nozzle (J). As a result of the introduction of the argon into the bottle, the air, which was present in the head of the bottle is pushed out through outlets (I) as shown by the arrows in FIG. 2.

FIG. 3 shows the same specific embodiment of the stopper as in FIGS. 1 and 2, but after actuation and after closure of the closing means (K) showing that in this state the oxygen-poor atmosphere that is present inside the head space of the bottle is protected from the outside atmosphere in an air-tight manner.

Figure 4:
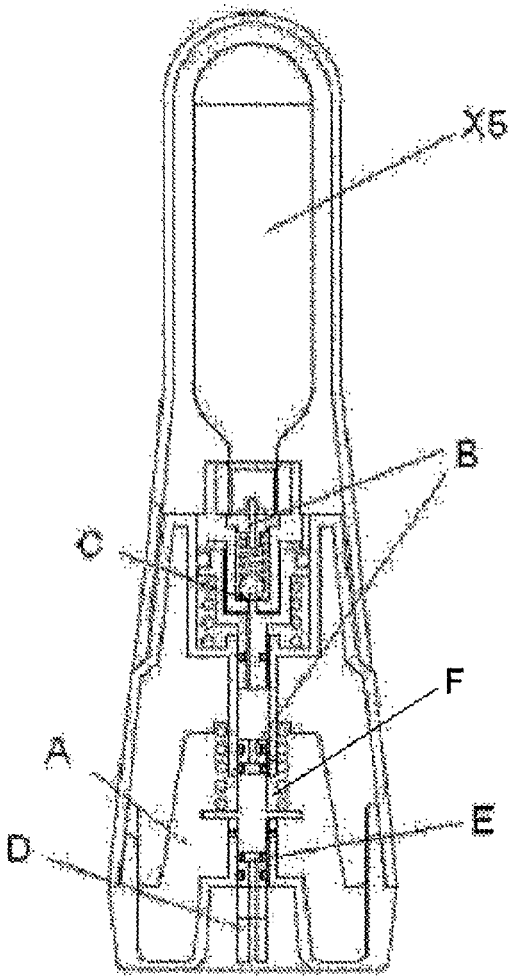
FIG. 4 is a schematic representation of another embodiment of the inert gas injecting device of the invention.

FIG. 4 represents another specific embodiment of the first aspect of the invention wherein a pressurized inert gas supply, e.g. argon cartridge or canister (X5) is connected to the gas chamber through connecting means (B), and wherein the gas pressure in the gas chamber is fixed by the pressure regulating means (C), in this case a pressure reduction valve. Other aspects of this device are the same as mentioned for the embodiments shown in FIGS. 1 to 3.

Figure 5:
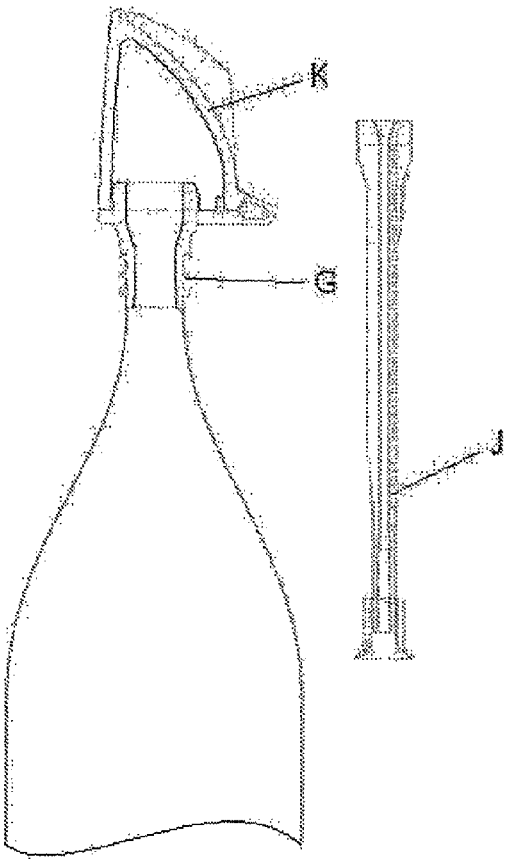
FIG. 5 represents another specific embodiment of the second aspect of the invention.

FIG. 5 shows another specific embodiment of the second aspect of the invention, wherein the nozzle is removable and is removed prior to the closure of closing means (K). Other aspects of this device are the same as mentioned for the embodiments shown in FIGS. 1 to 4.

Figure 6:
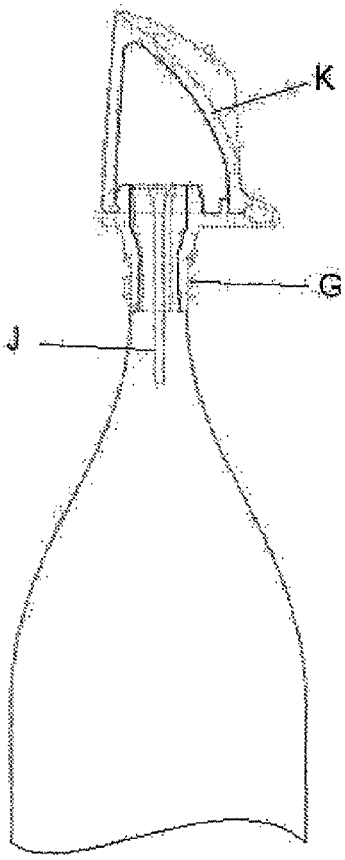
FIG. 6 represents yet another specific embodiment of the second aspect of the invention.

FIG. 6 shows yet another specific embodiment of the second aspect of the invention, wherein the nozzle (J) as a length of about 3-4 cm. Other aspects of this device are the same as mentioned for the embodiments shown in FIGS. 1 to 5.

Figure 7:
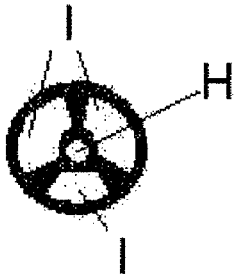
FIG. 7 represents a cross section view of the stopper represented in FIG. 6.

FIG. 7 shows a cross-section view of the stopper of FIG. 6. The ratio of the cross-section of the outlets (I) to the cross section of the inlet (H) is higher than 1.5.

The present invention includes within its scope modifications to the devices described with reference to FIGS. 1 to 7. For example, a plurality of chambers (A) may be arranged circumferentially around central internal gas feeding channels (X2, X3) each of the chambers (A), when the device is at rest, having openings in contact with the T-shaped internal channel (X2) of the piston that is connected to the argon canister or cartridge, to allow filling of the gas chambers (A) with inert gas, e.g. argon. Upon actuation, by pressing the charging head (D) onto the upper part of the stopper, the piston is pushed into a higher position where the T-shaped channel (X2) connected to the canister or cartridge is moved away from the openings of the gas chambers, disabling the connection between the canister or cartridge and the gas chambers. At the same time, the T-shaped channel (X3) connected to the charging head is moved in front of the openings of the gas chambers, allowing the inert gas, e.g. argon from the gas chambers to flow through the charging head, e.g. into a wine bottle. In a further variation of this arrangement, each of the chambers (A) can be provided with a manually operated isolation valve that isolates that chamber (A) from the internal channels (X2, X3). By this means, various volumes of gas can be preset for introduction into the container, e.g. wine bottle by activating its isolating valve to allow gas flow into the internal channels (X2, X3).

In addition, the internal channels X2, X3 need not be in the center of the device—the arrangement could be turned inside out and one or more of the channels could be placed more to the outside with a central gas chamber (A).

In a further embodiment of the device for controlling gas introduction the pressurized inert gas, e.g. argon cartridge or canister is only connected to a gas chamber (A) (or gas chambers) during activation of the device. At rest the gas supply is disconnected from the chamber (A). As in previous embodiments, the actuation means (F) can be in the form of a spring mounted piston (X1) having two T-shaped internal channels (X2 and X3). The first internal channel (X2) is connected to the inert gas, e.g. argon, canister or cartridge through connecting means (B) and the second channel (X3) is connected to a charging head (D). At rest, the piston is forced by the spring into a lower position where the openings of the gas chamber are not in contact with the T-shaped internal channel (X2) of the piston that is connected to the argon canister or cartridge. These openings of the gas chamber are in contact with the T-shaped internal channel (X2) of the piston only during the return operation of the device to thereby fill the gas chamber (A) with argon. Upon actuation, by pressing the charging head (D) onto the upper part of the stopper, the piston is pushed into a higher position where the T-shaped channel (X2) connected to the canister or cartridge is first aligned with the openings of the gas chamber, enabling the connection between the canister or cartridge and the gas chamber (e.g. to top up the chambers if required). Further movement results in the piston being pushed into a still higher position where the T-shaped channel (X2) connected to the canister or cartridge is moved away from the openings of the gas chamber, disabling the connection between the canister or cartridge and the gas chamber. At the same time, the T-shaped channel (X3) connected to the charging head is moved in front of the openings of the gas chamber, allowing the argon from the gas chamber to flow through the charging head, e.g. into a wine bottle. On the return stroke the openings in the chamber disengage from the channel (X3) and align with the channel (X2) again allowing filling. Further movement brings the piston into its rest position with the chambers sealed off. This arrangement allows removal of the pressurized canister or cartridge without depressurizing the chambers (A). Other details are as described with respect to the other embodiments of FIGS. 1 to 7.

In a further embodiment the gas supply can be provided by a pressurised inert gas can such as a spray can which has a valve for release of the gas when this is depressed. This can is preferably adapted to locate onto the inlet of a stopper such as described above. Alternatively the stopper may be adapted to have an inlet that can receive the outlet of the can. For example, the can contains enough gas for one use, i.e. a single shot pressurised inert gas supply.

Also more than one nozzle may be provided if required in any of the embodiments of the present invention.

The invention claimed is:

1. A device for use in the preservation of a degradable substance in a container with an opening, the device comprising:

a gas chamber (A), a first connecting means (B) having an internal channel (X2) for providing a gas connection between a pressurized inert gas supply and the gas chamber, a charging head (D) for delivering gas into the container, a second connecting means (E) having an internal channel (X3) for providing a gas connection between the gas chamber (A) and the charging head (D), actuation means (F) for delivering the gas from the gas chamber to the container through the charging head (D), wherein the pressure in said gas chamber (A) is regulated to a predetermined pressure when the pressurized gas supply is connected to the gas chamber (A), and wherein the second connecting means (E) is disabled when the actuation means (F) is at rest and that the first connecting means (B) is disabled upon actuation of the actuation means (F) allowing the device to deliver a pre-determined amount of the inert gas through the charging head (D).

2. A device according to claim 1, further comprising regulating means (C) for regulating the pressure in said gas chamber to a predetermined pressure when the pressurized gas supply is connected to the gas chamber (A).

3. A device according to claim 2, wherein the regulating means (C) is a pressure reduction valve.

4. A device according to claim 1, wherein the predetermined pressure in the gas chamber has a pressure between 3 and 7 bar.

5. A device according to claim 1, wherein the predetermined amount of the inert gas is between 100 and 200 ml.

6. A stopper for use with a device according to claim 1 and a container with an opening, comprising:

a skirt (G) for sealing the outside part of the stopper to the inside of the opening, an inlet channel (H) allowing a gas delivered by the charging head (D) of the device of claim 1 to enter the container, one or more outlet channels (I) allowing air in the container to exit, a nozzle (J) extending the inlet channel of the stopper inside the container, closing means (K) for preventing the air outside the container to access the inlet channel (H) and the one or more outlet channels (I), wherein the ratio of the cross section of the one or more outlet channels (I) to the cross section of the inlet channel (H) is at least 1.5.

7. A stopper according to claim 6, wherein the nozzle (J) is removable.

8. A stopper according to claim 6, wherein the stopper is made of one or more thermoplastic polymers.

9. A kit for wine preservation comprising a device according to claim 1 and one or more stoppers according to claim 6.

10. A device for use in the preservation of a degradable substance in a container with an opening, the device comprising:

a gas chamber (A), a first connection (B) having an internal channel (X2) for providing a gas connection between a pressurized inert gas supply and the gas chamber, a charging head (D) for delivering gas into the container, a second connection (E) having an internal channel (X3) for providing a gas connection between the gas chamber (A) and the charging head (D), an actuator (F) for delivering the gas from the gas chamber to the container through the charging head (D), wherein the pressure in said gas chamber (A) is regulated to a predetermined pressure when the pressurized gas supply is connected to the gas chamber (A), and wherein the second connection (E) is disabled when the actuator (F) is at rest and that the first connection (B) is disabled upon actuation of the actuator (F) allowing the device to deliver a pre-determined amount of the inert gas through the charging head (D).

11. A device according to claim 10, further comprising a regulator (C) for regulating the pressure in said gas chamber to a predetermined pressure when the pressurized gas supply is connected to the gas chamber (A).

12. A device according to claim 11, wherein the regulator (C) is a pressure reduction valve.

13. A device according to claim 10, wherein the predetermined pressure in the gas chamber is between 3 and 7 bar.

14. A device according to claim 10, wherein the predetermined amount of the inert gas is between 100 and 200 ml.

15. A stopper for use with a device according to claim 1 and a container with an opening, comprising:

a skirt (G) for sealing the outside part of the stopper to the inside of the opening, an inlet channel (H) allowing a gas delivered by the charging head (D) of the device to enter the container, one or more outlet channels (I) allowing air in the container to exit, a nozzle (J) extending the inlet channel of the stopper inside the container, a closure (K) for preventing the air outside the container to access the inlet channel (H) and the one or more outlet channels (I), wherein the ratio of the cross section of the one or more outlet channels (I) to the cross section of the inlet channel (H) is at least 1.5.

16. A stopper according to claim 15, wherein the nozzle (J) is removable.

17. A stopper according to claim 15, wherein the stopper is made of one or more thermoplastic polymers.

* * * * *